US006419033B1

(12) United States Patent
Hahn et al.

(10) Patent No.: US 6,419,033 B1
(45) Date of Patent: Jul. 16, 2002

(54) APPARATUS AND METHOD FOR SIMULTANEOUS DRILLING AND CASING WELLBORES

(75) Inventors: Detlef Hahn, Hannover; Friedhelm Makohl, Hermannsburg, both of (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/733,220

(22) Filed: Dec. 8, 2000

Related U.S. Application Data

(60) Provisional application No. 60/170,108, filed on Dec. 10, 1999.

(51) Int. Cl.[7] ..... E21B 7/08

(52) U.S. Cl. ..... 175/61; 175/73; 175/171

(58) Field of Search ..... 175/45, 61, 73, 175/76, 171

(56) References Cited

U.S. PATENT DOCUMENTS

| | | | | |
|---|---|---|---|---|
| 4,612,987 A | * | 9/1986 | Cheek | 175/325 |
| 4,844,178 A | | 7/1989 | Cendre et al. | 175/73 |
| 4,848,488 A | | 7/1989 | Cendre et al. | 175/61 |
| 5,060,736 A | * | 10/1991 | Neff | 175/74 |
| 5,074,366 A | | 12/1991 | Karlsson et al. | 175/76 |
| 5,343,964 A | | 9/1994 | Leroy | 175/61 |
| 5,845,722 A | | 12/1998 | Makohl et al. | 175/101 |

FOREIGN PATENT DOCUMENTS

| | | |
|---|---|---|
| GB | 2077811 A | 12/1981 |
| WO | WO93/25799 | 12/1993 |
| WO | WO98/34003 | 8/1998 |
| WO | WO88/58807 | 11/1999 |
| WO | WO00/28188 | 5/2000 |

* cited by examiner

*Primary Examiner*—William Neuder
(74) *Attorney, Agent, or Firm*—Madan, Mossman & Sriram, P.C.

(57) ABSTRACT

The present invention provides apparatus and method for drilling a wellbore wherein a pilot wellbore section is drilled with a bit which section is enlarged by a trailing underreamer to the desired size. One or more steering sections between the underreamer and the drill bit are utilized for maintaining and changing the drilling direction. Each steering section includes a plurality of independently adjustable force application devices on a non-rotating sleeve. If an expandable liner is used, then an expansion device disposed above the underreamer expands the liner during retrieval of the drilling assembly to the surface.

12 Claims, 3 Drawing Sheets

APPARATUS AND METHOD FOR SIMULTANEOUS DRILLING AND CASING WELLBORES

CROSS REFERENCES TO RELATED APPLICATIONS

This application claims priority from U.S. Provisional Application Ser. No. 60/170,108 filed on Dec. 10, 1999.

BACKGROUND OF THE INVENTION

1. Field of the Invention

This invention relates generally to oilfield drilling operations and more particularly to simultaneous drilling and casing of wellbores with a drill string utilizing a liner or casing and a steerable drilling assembly.

2. Background of the Art

In conventional manner, oil wells (wellbores) are drilled with a drill string having a drilling assembly with a drill it at its bottom, and a tubular member (either a jointed pipe or coiled tubing) attached to the drilling assembly that extends to the surface. Once a section of the well has been drilled, the drill string is retrieved to the surface and a casing, which extends to the surface, is set in the well to protect the open hole. A liner is hung below the upper casing using a liner hanger connection device, which usually includes two threaded connections at its bottom. The liner is connected to the outer thread. The inner threaded connection is used to connect a string inside that liner, which string extends below the liner hanger. The next section of the wellbore is drilled below the first liner and this procedure is repeated until the telescopically declining diameter wellbore is drilled to the desired depth. Such drilling methods require tripping the entire drill string out of the wellbore for lining each telescopic section of the wellbore.

Wellbores are sometimes drilled wherein the liner itself is employed to carry the drilling assembly. The drilling assembly used for such operations includes a drill bit at the bottom to drill a pilot (small diameter) hole followed by an underreamer which enlarges the pilot hole to a size greater than the outer dimensions of the liner. The drilling assembly is retrievably attached to the liner bottom and can be retrieved without retrieving the liner.

To drill curved holes, the underreamer drilling assemblies typically use a bent housing (also referenced to as a "bent sub") whose attitude is fixed either at the surface or downhole, which attitude defines the drilling direction. Such drill strings are sometimes unable to provide precision directional drilling.

The present invention provides apparatus and method for drilling wellbores with liners which allow relatively precise directional control. This invention further provides apparatus and method wherein an expandable liner may be used during the drilling process, which liner can ne expanded while the drilling assembly is retrieved to the surface, thereby avoiding a secondary operation required to expand the expandable liner.

SUMMARY OF THE INVENTION

The present invention provides apparatus and method for drilling a wellbore with a drilling assembly wherein a pilot wellbore section is drilled with a bit which section is enlarged by a trailing underreamer to the desired size. The drilling assembly includes one or more steering sections between the underreamer and the drill bit are utilized for maintaining and changing the drilling direction. Each steering section includes a plurality of independently adjustable force application devices on a non-rotating sleeve. The drilling assembly is retrievably attached at its upper end to a liner that will be set in the wellbore once at least a section of the wellbore has been drilled. The liner may be any suitable tubing including a expandable liner. If an expandable liner is used, then an expansion device disposed above the underreamer is utilized to expand the liner during retrieval of the drilling assembly to the surface.

The independently adjustable force application devices provide for a relatively precise control of the direction of drilling. A control unit on the surface and/or in the drilling assembly controls the force applied by each of the force application devices in accordance with programmed instructions and/or commands provided from surface. One or more sensors in the drilling assembly and at the surface provide information about various parameters of interest, including the tool face of the drilling assembly, force applied by each application device, and position of the drilling assembly. The control unit includes an electronic processor (computer, microprocessors and the like) and controls the operation of the force application device, at least in part, in response to or as a function of one or more parameters, of interest, thereby controlling and/or maintaining the drilling direction along a desired path.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

FIG. shows a drilling assembly that can expand an expandable liner as the drilling assembly is tripped out of the wellbore.

DETAILED DESCRIPTION OF THE PREFERRED EMBODIMENT

Figure 1:
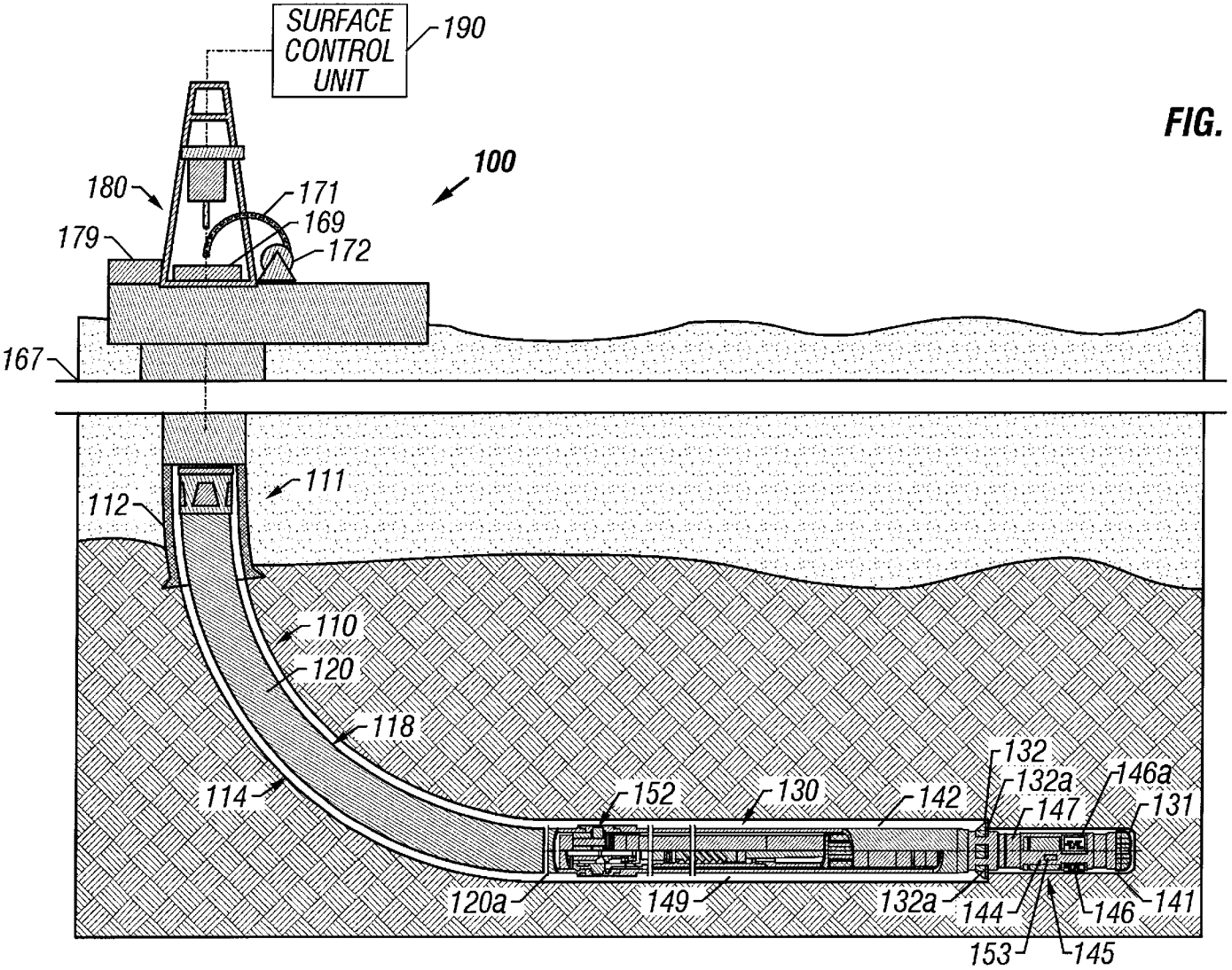
FIGS. 1 is a schematic diagram of a horizontal wellbore being drilled with a drilling assembly of the present invention conveyed by a liner.

FIG. 1 is a schematic diagram showing a drilling system 100 with a liner drill string for drilling wellbores according to one embodiment of the present invention. FIG. 1 shows a wellbore 110 that includes an upper section 111 with a casing 112 installed therein, and a lower section 114 (which is smaller in diameter than the upper section 111) being drilled with a liner drill string 118 that includes a drilling assembly 130. The drilling assembly 130 is attached to the bottom end 120*b* of the liner 120, which extends to a rig 180 at the surface 167. A rotary table 169 or a top drive (not shown) may be utilized to rotate the liner and thus the drilling assembly 130.

Alternatively, the drilling assembly 130 may be conveyed through the liner 120 via a coiled tubing 171 from a reel (source) 172 at the rig 180. The rig 180 also includes conventional devices, such as mechanisms to add additional sections to the liner 120 as the wellbore is drilled, a control unit 190, including computers for receiving and processing downhole data and for controlling operation of the various devices in the drilling assembly 130. A drilling fluid from a source thereof 179 is pumped under pressure through the liner 120 or through a tubing run inside the liner 120. Such apparatus and methods are known in the art and are not described in greater detail herein.

The drilling assembly 130 includes a drill bit 131 at its bottom end for drilling a pilot hole 141 (also referred to herein the first or leading section of the wellbore) and an underreamer 132 uphole or above the drill bit 131. The underreamer 132 has cutting members 132*a* which extend radially farther than the drill bit outside dimensions and thus can drill or expand the pilot hole to a larger diameter. The underreamer 132 has a plurality of cutting members 132*a* which can be extended outward so that the upper section 142 is larger than the drill string and drilling assembly dimensions. The dimension of the upper section 142 is the same as the dimension of the wellbore 110. This provides a wellbore that has a desired annulus 149 between the wellbore inside and the drill string 118.

A steering section or unit 145 between the drill bit 131 and the underreamer 132 provides downhole steering control for drilling wellbore 110 relatively precisely along a predefined or desired well path. The steering section 145 includes a nonrotating sleeve 144 that carries a plurality of independently controllable steering devices 146, each such device having an independently adjustable force application member 146*a* that can exert desired forces on the wellbore wall. Each steering device 146 may be integrated into the non-rotating sleeve 144. When the liner 120 is rotated from the surface, it rotates the drill bit, but the non-rotating sleeve 144 remains substantially stationary relative to the drill bit rotational speed. The sleeve 144 may rotate at a few rpm while the drill bit rotates usually between 60–200 rpm. The operation of the steering devices is described in more detail in reference to FIGS. 2 and 4. A control and measuring unit 147 controls the operation of each steering device 146. The control unit 147 preferably includes a hydraulic pump that supplies fluid under pressure to the force application members. A separate pump may be utilized for each force application device. An electrical motor or another suitable device may also be utilized to extend the force application members to exert force on the wellbore wall.

The drilling assembly 130 further includes a drilling motor (usually a mud motor) 149 which is utilized to rotate the drill bit 131 and may also be utilized to operate the underreamer 132. The control unit 147 may also be used to control the radial extension of the underreamer cutting members 132*a* or a separate control unit may be provided. Alternatively, the underreamer 132 may have fixed outside dimensions. The drilling assembly 130 is detachably attached to the liner 120 at an end 120*a* via a connection device 152. A variety of connection devices are known in the art. Any suitable mechanism may be utilized to attach the drilling assembly 130 to the liner 120. In such a configuration, the drilling assembly 130 is pulled out or retrieved or tripped out of the wellbore 110 by a tubing or wireline conveyed from the surface.

A coiled tubing 171, however, may be used to convey the drilling assembly through the liner 120. In such a configuration, the drilling fluid is pumped through the coiled tubing 171. The mud with the cuttings (rocks disintegrated by the drill bit 131 and the underreamer) may flow through the annulus 149. If a coiled tubing is used inside the linear, the mud with the cuttings may be made to flow through the spacing between the coiled tubing and the liner inside (not shown).

The steering unit 145 includes one or more sensors 153 for providing signals indicative of the borehole inclination. Three axis accelerometers are commonly used as inclination sensors. A position sensor is used to determine the position of the drilling assembly or drill bit relative to a known position. The drilling assembly direction is determined via one or more suitable sensors. The drilling assembly 130 also may include any of the measurement-while-drilling and formation evaluation sensors. Such sensors include, resistivity sensors, gamma-ray detection sensors, magnetometers, and a variety of other sensors, such as nuclear, acoustic and nuclear magnetic resonance sensors. Such sensors are commercially available and are used in drilling assemblies and are thus not described herein.

Figure 2:
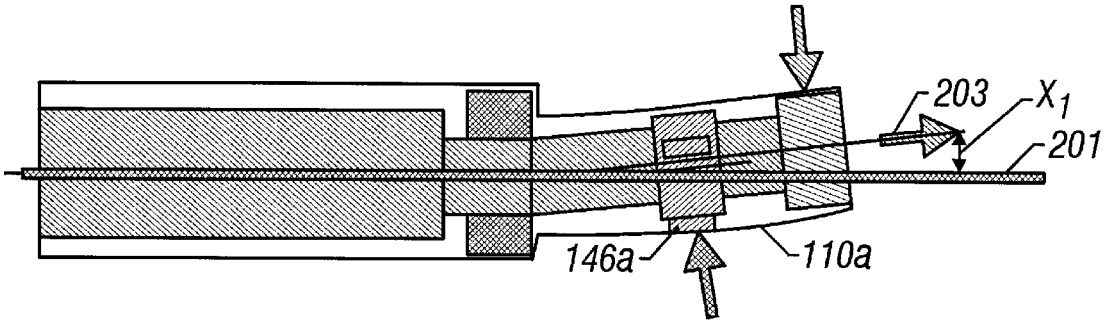
FIG. 2 shows an example of the application of independent forces on the borehole wall by the drilling assembly of FIG. 1 to maintain and control the drilling direction.

The drilling of the wellbore 110 will now be described while referring to FIGS. 1 and 2. The drill string 118 is conveyed in the wellbore. The drill bit is rotated by the mud motor (when mud motor is used) and/or by rotating the liner 120 from the surface. The drill bit 131 drills the pilot hole of a first (smaller) diameter. The underreamer cutting members 132*a* are expanded to a desired size, which enlarges the pilot hole to the required wellbore size. To alter the drilling direction, the control unit 147 activates one or more of the steering devices 146. As shown in FIG. 2, each steering device includes an expandable force application member (also referred herein as a "rib") such as the rib 146*a*. Each expanded rib 146*a* exerts a predetermined force on the wellbore wall 110*a*. The combination of the amounts of the forces exerted by the ribs determines the drill bit direction. In FIG. 2, the drilling direction is shown to have been altered from the prior direction denoted by line or axis 201 by a $X_1$ degrees to the current direction denoted by the axis 203.

In one method of the present invention, the command signals may be transmitted or telemetered downhole by the surface control unit 190, which, as stated above, preferably is a computer-based system. The downhole steering control unit 147, in response to the command signals, activates the specified ribs to apply the predetermined force on the wellbore wall 110*a* to achieve or maintain the desired drilling direction. In an alternative method, the desired well path may be programmed into a memory unit associated with the steering control unit 147. The control unit 147 then periodically determines the actual drilling direction from the sensors 153, compares this direction with the desired well path and causes the various steering devices to adjust their respective forces on the wellbore so that the combined effect causes the drill bit to drill the wellbore 110 along the prescribed well path. The operating parameters relating to the drilling direction (inclination, azimuth etc.) may also be transmitted to the surface where the surface control unit 190 may be utilized to send control signals to the downhole controller 147 to override the actions of the downhole control unit 147. The downhole control unit 147 may also be reprogrammed by telemetered signals from the surface control unit 190. One or more sensors, such as a pressure sensor or displacement sensor associated with each rib 146*a* provides signals indicative of the force applied by its associated rib on the wellbore wall. Programs are stored in the downhole control unit 147 to calculate the force vector on the drill bit 131.

Thus in one embodiment of the present invention, the wellbore is drilled by a drilling assembly conveyed in the wellbore by a liner (or casing) that is not retrieved , and wherein the drilling assembly includes a downhole controllable steering unit between a drill bit and an underreamer, which steering unit includes one or more independently-controllable steering device on a non-rotating sleeve for maintaining and altering the drilling direction. The steering unit may be self-adjusting or controlled from the surface. The method preferably is closed loop, in that the drilling is performed along a prescribed well path and that the drilling direction is altered when the actual drilling direction deviates from the prescribed well path. The drilling assembly is retrievably attached or conveyed into the wellbore without requiring tripping out of the liner.

Figure 4:
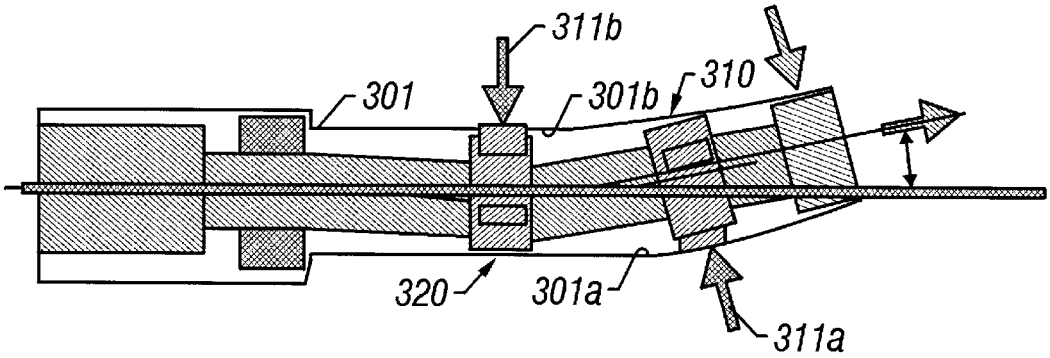
FIG. 4 shows an example of the application of independent forces on the borehole wall by the drilling assembly of FIG. 3 to maintain and control the drilling direction.
Figure 3:
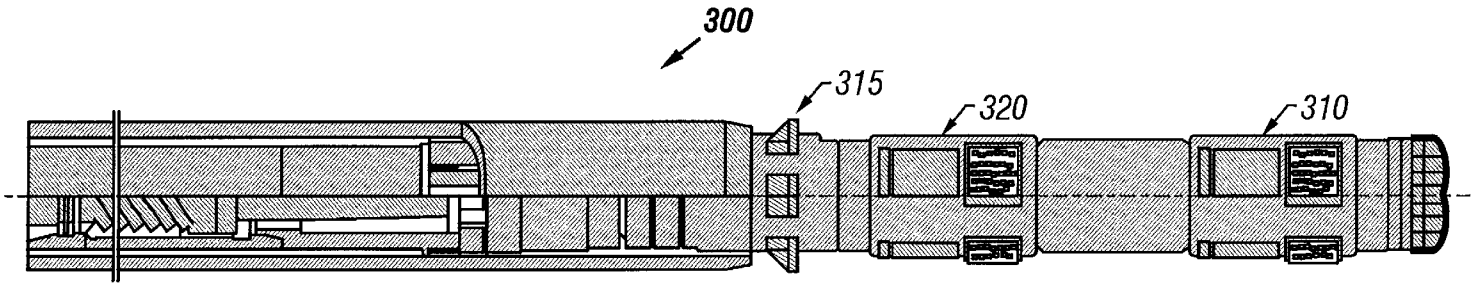
FIG. 3 is an alternative embodiment of the drilling assembly according to the present invention for use with a drilling liner.

FIG. 3 shows an alternative embodiment of the drilling assembly 300 which is substantially similar to the drilling assembly 130 but includes two spaced apart steering units 310 and 320. Each such steering unit includes a plurality of steering devices on corresponding non-rotating sleeves 311 and 321. The steering units 310 and 320 operate in manner described above with reference to FIGS. 1–3. The use of two spaced-apart independently adjustable steering units can improve the directional drilling behaviors of the drilling system 100 of FIG. 2. The upper steering unit 320 is above the main steering unit 310 and is preferably mounted on a non-rotating sleeve to allow full secondary three dimensional ("3D") control or may be mounted on a rotating member or sleeve to allow for two dimensional ("2D") control of the upper steering unit 310. The underreamer 315 is located above the upper steering unit 320. FIG. 4 shows an example wherein the lower steering unit 310 and upper steering unit 320 exert force on opposite sides of the borehole wall to achieve a greater turning radius. In the example of FIG. 4, the lower steering unit 310 applies force on the bottom side 301*a* of the wellbore 301 (as shown by the arrow 311*a*) while the upper steering unit 320 applies force on the upper side 301*b* of the wellbore, as shown by the arrow 311*b*. The multiple steering unit configuration allows greater flexibility to control and maintain the drilling direction.

Figure 5:
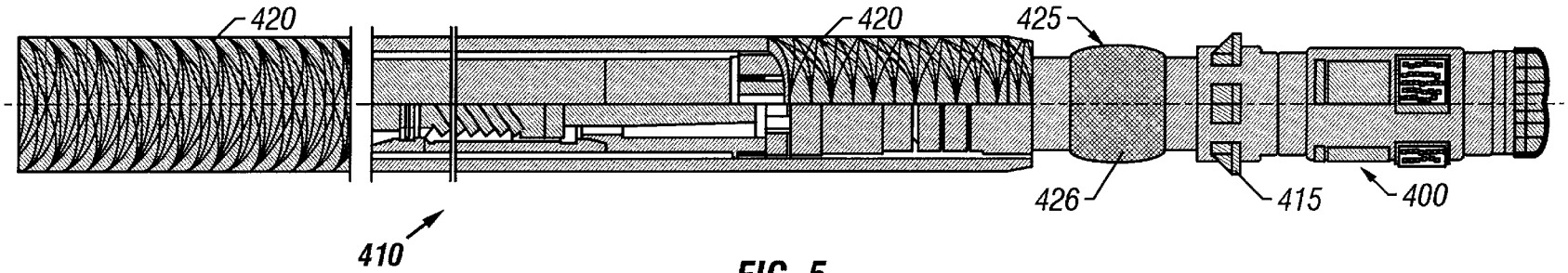

FIG. 5 shows an embodiment 410 of the present invention in which an expandable liner 420 is used. A liner expansion device 425 is disposed uphole of the underreamer 415, which device is adapted to expand the expandable liner 420 as the drilling assembly 400 is retrieved from the wellbore. The liner expansion device 425 includes an outer member 426 that is suitable for expanding the liner 420. After the well is drilled to a target depth, the drilling assembly 410 is pulled to the surface, the liner expansion device runs through the expandable liner 420, thereby expanding it to the larger diameter defined by the outer dimensions of the expansion device 425. Any suitable expansion device may be utilized for the purpose of this invention.

Thus, in the present invention, a pilot wellbore section is drilled with a drill bit, which is enlarged by a trailing underreamer to the desired size. One or more steering sections between the underreamer and the drill bit that include independently adjustable force application devices on one or more non-rotating sleeves are utilized to maintain and change the drilling direction. If an expandable lines is used, then an expansion device disposed above the underreamer expands the liner during retrieval of the drilling assembly to the surface.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus for drilling a wellbore, comprising:

(a) a liner for casing the wellbore;

(b) a drill bit at a first end of a drilling assembly for drilling a pilot wellbore;

(c) at least one set of a plurality of force application devices on a nonrotating sleeve of the drilling assembly, each said force application device independently operable to exert force on the pilot wellbore for controlling direction of drilling of the wellbore; and (d) an underreamer disposed uphole of the at least one set of the force application devices adapted to enlarge the pilot wellbore to produce said wellbore when rotated.

2. The apparatus of claim 1, wherein said drilling assembly is conveyed on a drilling tubular selected from a group consisting of (i) a drill string, and, (ii) a coiled tubing.

3. The apparatus of claim 1, wherein the at least one set of a plurality of force application devices further comprises two spaced-apart sets of a plurality of force application devices.

4. The apparatus of claim 1, wherein the liner is expandable, the apparatus further comprising a liner expansion device that expands the liner when said drilling assembly is retrieved from said wellbore.

5. The apparatus of claim 1 wherein the drilling assembly further comprises a drilling motor for rotating the drill bit.

6. The apparatus of claim 1 further comprising a control unit that controls the force application devices to exert desired force on the pilot wellbore.

7. The apparatus of claim 6 further comprising a program associated with said control unit that includes a prescribed wellbore path and wherein the control unit controls the force application devices to maintain drilling along the prescribed wellbore path.

8. The apparatus of claim 6 further comprising a sensor providing a measure of a parameter of interest and wherein the control unit adjusts the force applied by the force application devices in response to the measure of the parameter of interest.

9. A method of drilling a wellbore comprising:

(a) conveying a drilling assembly on a drilling tubular into the borehole;

(b) using a drill bit conveyed on a first end of the drilling assembly for drilling a pilot wellbore;

(c) using a plurality of force application devices on a non-rotating sleeve of the drilling assembly for independently exerting a force on the pilot wellbore and controlling the direction thereof;

(d) using an underreamer disposed near a second end of the drilling assembly and enlarging the pilot wellbore to produce said wellbore; and (e) using a liner coupled to the underreamer for lining said borehole.

10. The method of claim 9, wherein the drilling tubular is selected from a group consisting of (i) a drill string, and, (ii) a coiled tubing.

11. The method of claim 10, wherein the liner is expandable, the method further comprising retrieving the drilling assembly from the wellbore, the method further comprising using a liner expansion device on the drilling assembly for expanding the liner during said retrieval.

12. The method of claim 10 further comprising using a drilling motor in the drilling assembly for rotating the drill bit.

* * * * *